US005897481A

United States Patent [19]

Baumuller

[11] Patent Number: 5,897,481

[45] Date of Patent: Apr. 27, 1999

[54] MACHINE FOR MAKING CELLULAR PACKAGING

[75] Inventor: Théodore Baumuller, Schweighouse sur Moder, France

[73] Assignee: Naturembal (S.A.), Bouxwiller, France

[21] Appl. No.: 08/894,095

[22] PCT Filed: Jan. 8, 1996

[86] PCT No.: PCT/FR96/00023

§ 371 Date: Dec. 5, 1997

§ 102(e) Date: Dec. 5, 1997

[87] PCT Pub. No.: WO96/22187

PCT Pub. Date: Jul. 25, 1996

[30] Foreign Application Priority Data

Jan. 19, 1995 [FR] France ..... 95 00743

[51] Int. Cl.[6] ..... B31F 1/00; B65D 85/43

[52] U.S. Cl. ..... 493/464; 493/407; 493/379; 101/3.1; 101/22; 101/23

[58] Field of Search ..... 493/464, 84, 85, 493/93, 141, 374, 379, 381, 407; 101/3.1, 5, 6, 7, 22, 23, 24

[56] References Cited

U.S. PATENT DOCUMENTS

| | | | |
|---|---|---|---|
| 4,021,289 | 5/1977 | Orzelek et al. | 53/508 |
| 4,181,070 | 1/1980 | Robbins et al. | 493/379 |
| 4,455,903 | 6/1984 | Kesten | 83/346 |
| 4,498,390 | 2/1985 | Bowling et al. | 101/6 |
| 4,732,082 | 3/1988 | Ireton | 101/23 |
| 4,807,420 | 2/1989 | Barker | 53/550 |
| 5,318,807 | 6/1994 | Gili Picoy | 101/3.1 |
| 5,339,730 | 8/1994 | Ruppel et al. | 101/23 |
| 5,340,638 | 8/1994 | Sperner | 493/464 |

FOREIGN PATENT DOCUMENTS

| | | | |
|---|---|---|---|
| 1666360 | 7/1991 | U.S.S.R. | 493/374 |

*Primary Examiner*—James F. Coan
*Assistant Examiner*—Gene L. Kim
*Attorney, Agent, or Firm*—Abelman, Frayne & Schwab

[57] ABSTRACT

Machine for continuously making cellular packaging from a paper-like web material wound around at least one roll (2, 3) freely rotatable located at the input of the machine, each web travelling thereafter through a station (C) creating a transversal crease, then between two rolls (14, 34), at least one of which being driven by a drive means, allowing on the one hand the continuous driving of the web and on the other hand the moulding of the cells, one of said rolls (14) having over its peripheral surface male prints (15) of the cells whereas the other roll (34) has over its peripheral surface female prints (35) of the cells, the engagement of both male and female prints providing the driving of the web, which travels finally through an output station (E) having a cutting system connected to a drive means, cutting at regular intervals the cellular packaging web obtained at the output, characterised in that both driving rolls (14, 34) including said male prints (15) and female prints (35) are each disposed in a module (M1, M2), which is easily accessible and can be dismantled from outside the machine, comprising two lateral end plates (18, 19) linked by a shaft (38, 39) supporting a heating means (36, 37) and said moulding roll (14, 34), said heating means and moulding rolls being mechanically independent and superposed, the first one being fitted into a central bore of the second, the latter remaining freely rotatable and being readily extractable once one of the end plates has been removed.

10 Claims, 2 Drawing Sheets

MACHINE FOR MAKING CELLULAR PACKAGING

This invention relates to a machine for continuously making cellular packaging from a web material such as paper which is moulding to create alveolus or cells according to several distribution patterns, and which are cut into rectangular pieces adapted to be placed e.g. in the bottom of boxes or crates.

The most usual application of such cellular packaging is the separation of fruits in a crate, each fruit having its own cell in which it is protected against any compression resulting from possible contacts with the neighbour fruits. There is usually only one layer of fruits to prevent also from any crushing of a layer by the weight of an upper layer.

The diameters of the cells, which are generally of hemispherical shape, are selected according to the fruits to be conditioned. Their primary function is therefore to prevent any contact between the fruits, and also to prevent any contamination when a fruit starts to go mouldy or to be rotten, which can happen as soon as a sound product contacts an altered product.

The machines for making such packaging make use of a continuous web-like material, generally a band of paper from paper rolls. Depending on the case, there can be used one or several rolls at the machine input, rotating freely and feeding continuously the machine.

Each paper web is then fed through a longitudinal station which creates a transversal crease of the web by means of a metal sheets system having transversal creases, and cooperating with rolls which press the web against the metal sheets, progressively achieving the creasing thereof.

The web(s) are then fed to the moulding station where the cells are moulded by a couple of substantially cylindrical rolls, one of said rolls having in its peripheral surface positive prints or moulds corresponding to the volumes defined by the cells and the other roll having in its peripheral surface corresponding negative prints or moulds. In other words, the moulds of one roll are fitting into the moulds of the other roll during the course of the process.

Said both rolls are therefore playing two functions:

on the one hand they are driving continuously the web(s) of paper, and on the other hand, they are moulding cells into the mono or multi layer paper web which is fed therebetween.

At the output, a continuous web is obtained, in which cells are regularly distributed. Finally, to obtain packaging products commercially usable, it is provided an output station through which the cellular packaging material is transversally cut at regular intervals, and is also longitudinally cut, so that rectangular pieces having a size adapted to the boxes and crates provided to contain the fruits are obtained.

It is clear that such machines are representing an important financial investment, due to their size and their mechanical complexity, resulting from the number of functions they have to assume. In addition, such machines must be adapted to make cellular packaging for a variety of sizes and natures of fruits and/or vegetables.

However, it is also clear that, whereas each size of product requires a specific couple of rotative moulding rolls, it is obviously not possible to use machines having an unique couple of moulding rolls, except if using a plurality of machines, which would be financially unthinkable. It is therefore required to change the moulding rolls each time the product to be packaged changes.

However, in the presently used machines, such a change is time consuming. In fact, the moulding of the cells is carried out at elevated temperature and pressure, failing which the cells made in web would not last. The heat is generally provided by stream, at a pressure of about $10.10^5$ Pa, and at a temperature of about 200° C.

The devices used to obtain such conditions are complex and difficult to assemble and dismantle.

One object of this invention is to provide a machine with moulds which are easy to assemble and dismantle, to be able to use the same machine with various product sizes.

Another object of the invention is to provide such a machine with heating means easy to control, which makes also easy the assembling and dismantling process of the machine.

Another object of the invention is to offer a machine whose design has been optimized to make it easy to use and to maintain by nonqualified maintenance employees.

Another object of the invention is to provide a machine which is economically improved by way of the above optimized concept.

Such objects are achieved according to invention by a machine having two specific modules containing simultaneously the entire heating means and the cylindrical moulds.

Said modules are placed at an easily accessible place in the machine, and can be easily assembled and dismantled, being fastened by usual mechanical means, e.g. bolts and nuts. In addition, they do not require complex connections with external apparatuses such as e.g. a steam source.

Said modules schematically comprise a fixed frame, including two lateral plates similar to each other, connected by a shaft supporting the heating means which is also fixed in said frame, and the moulding roll rotating freely in said frame. Said roll is disposed about said heating means, which is loosely lodged in a central bore thereof.

To remove said moulding roll, it is only necessary to dismantle the associated module, then one of said lateral plates, and to extract the mould, which is neither fastened to the module frame, nor to the heating means, but to rotating driving elements. The replacement of a mould by another one is therefore extremely simple and easy.

According to another essential feature of the invention, the heating means are uniquely electrical means, comprising a substantially cylindrical coil having heating hair-pin type shaped resistors. Said resistors are producing heat by Joule effect. As explained above, said coil is attached to the moveable module frame and covered by the moulding roll to wards which it leads the produced heat by radiation. The roll is coaxial with its heating coil.

The mechanical independence between the moulding roll and the fixed heating means has a further advantage: the produced heat is uniformly spread over the periphery even if one of the hair-pin type shaped resistor does not work.

According to a possible embodiment, the heating mould, rotating freely about the fixed frame, is driven by an external motor to which it is connected through a gear located in the module and fixed to the roll.

The heating coil is connected to a temperature sensor placed inside the roll, in order to maintain a sufficient temperature in the internal volume and therefore upon the useful heating part, i.e. the external peripheral surface of the roll. Generally, considering the used materials, an internal temperature of about 400° C. should be maintained to warrant an external temperature of about 200° C., which is required for a sufficiently lasting moulding of the cells.

According to a preferred embodiment, the design of the modules is based on a double symmetry of the frame, about its central axis and about a middle transversal plane. This concept results in a basic simplification: the central shaft is limited by two identical end plates, preferably made of metal, to which is fastened the heating coil, around which is disposed the moulding roll and its driving elements.

The moulds are preferably made of Cn—Al alloy, with a view to lengthen their life and to prevent some mechanical drawbacks offered by other materials, as for instance the creep of the metal.

At the machine output, the web is cut at regular intervals, by an unbalance with a cutting edge or an outlying piece having also a sharp edge provided to cut the web. Such a device extends transversely to the machine along a width at least equal to the width of the web to cut. The same condition applies to the sharp edge of the outlying piece, which can be one generating line of the substantially cylindrical unbalance. The rotation shaft supporting said unbalance is connected to driving means which drive it at a continuous and uniform rotation speed, in synchronism with the moulding rolls rotation, to provide cutting at regular intervals. The web is also latterally cut by a system of blades and counter-blades.

According to a first embodiment, the web is a monolayer web. According to a modification thereof, the machine of the invention can be fed by a two-layers web. The final multilayer cellular web, i.e. the two-layers web, is then made of two laminated layers provided by two input rolls.

The sticking is carried out in two steps. Firstly, downstream of the paper rolls is provided a number of transversal rolls, one of which is dipping into a glue bowl, so that its peripheral surface is coated with glue, since it is uniformly rotating. A second roll, in contact with said first roll, transfers the glue to a third roll located downstream and having superficial raised portions which are in contact with one of the paper webs, so that there are glue spots regularly disposed over its entire surface.

Each continuous web is then travelling through a station achieving, upon each web, an identical transversal crease. A final gluing results from the moulding step between both heating and moulding rolls, which provide simultaneously a lamination of both webs and the overall driving of the material.

Said gluing being performed simultaneously with the cells moulding, there is no undue slipping of one web upon the other.

The invention will now be described with reference to the annexed drawings in which.

Figure 1:
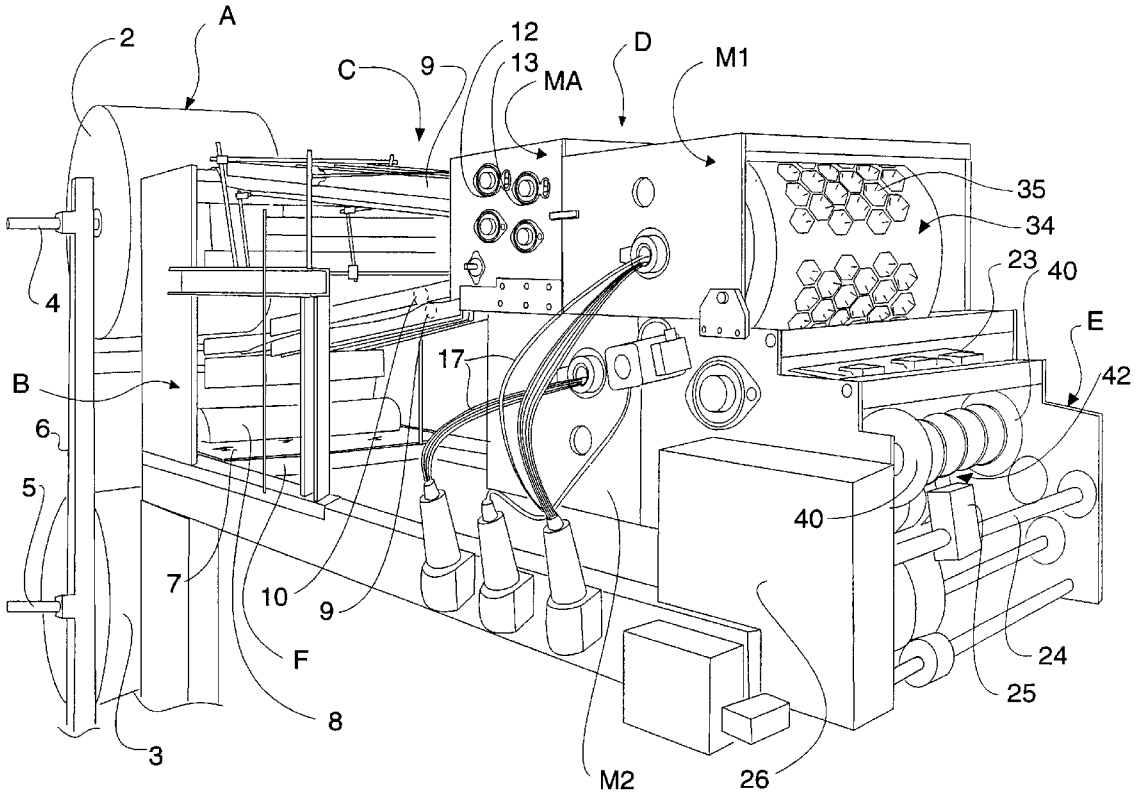
FIG. 1 is a perspective view of the complete machine for making cellular packaging according to the present invention, in the two-layers web embodiment.
Figure 2:
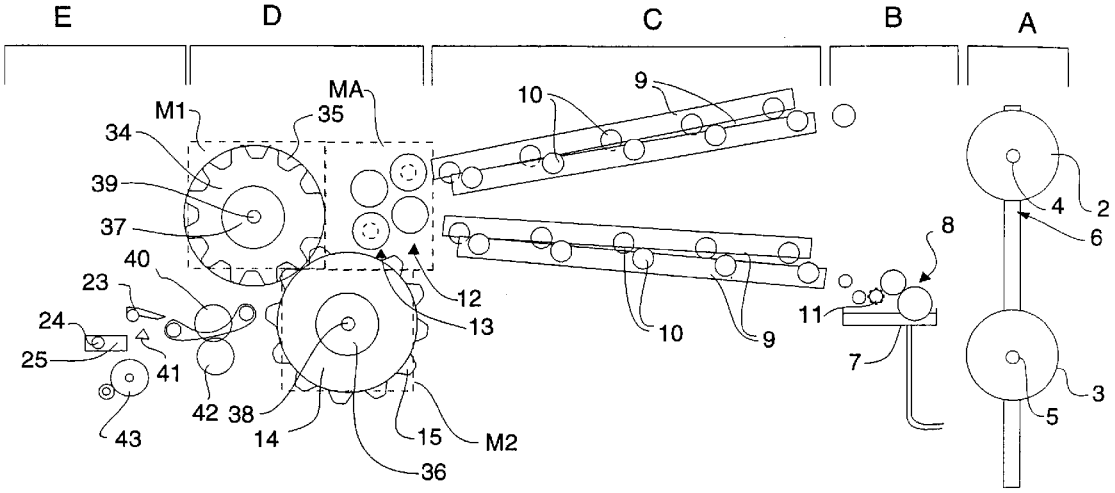
FIG. 2 shows schematically the longitudinal configuration of the machine, in the same embodiment, to make easier the understanding of the making process.

Referring to the drawings, FIG. 1 shows a complete view of an example of the machine of the invention. As shown in FIG. 2, said machine comprises essentially five successive stations corresponding to five steps of process carried out sequentially.

At the input A, the rolls (2, 3) rotate freely around their supporting shafts (4, 5), which are mounted upon an input gantry (6). The station B corresponds to the gluing step and comprises a vat (7) filled with glue and a number of rolls (8). The vat is connected by a pipe to a tank filled with glue (not shown), which feeds the vat (7) by means of pumping means (not shown) in a know manner.

The central station C is provided to perform a transversal crease via metal sheets (9) and wheels (10), also in a known manner, which will be described more in detail hereunder. Each paper web has it own transversal creasing system, both systems converging in the travelling direction, so that both continuous creased webs join at the input of the driving and moulding rolls.

The following station D comprises the modules (M1) and (M2) containing the moulding rolls. For clarity reasons, the drawing shows only the upper roll (34), having hollow or female, or even negative prints (35). As shown, said module (M1) is particularly easy to dismantle, due to its easy access. Access to the module (M2) is made easily possible, after dismantling of an auxiliary (MA) module which provides a first driving action upon the two-layer web, and prepares it before the moulding step itself.

Finally, the station (E) comprises the final preparation of the products, i.e. the cutting of the web into rectangular sections which are directly usable in boxes or crates.

This station (E) includes the cutting systems (23, 41, 40, 42) as well as printing means for printing information such as the gauge or size upon each final product (24, 25, 43).

Figure 3:
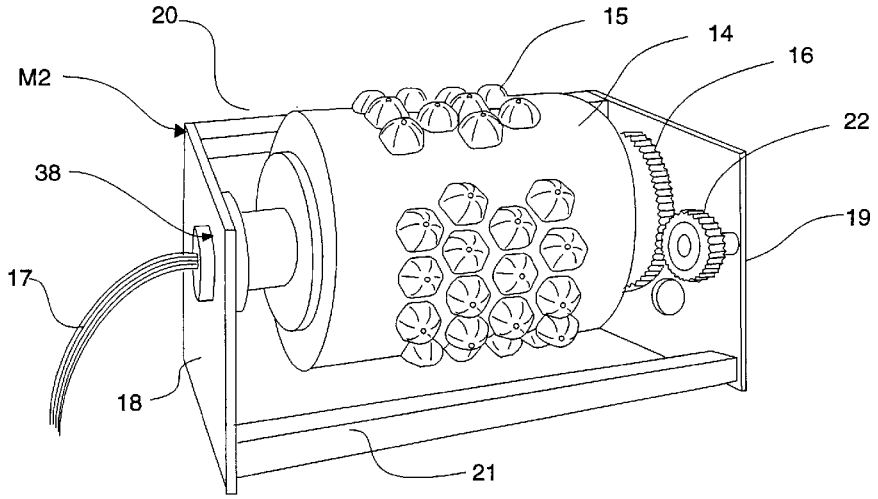
FIG. 3 is a perspective view of one of the modules according to the invention.

FIGS. 2 and 3 further show some details of the important features of the invention, and more specially of modules (M1) and (M2).

FIG. 1 and FIG. 2, considered simultaneously, give a schematic explanation of the overall process taken along its successive steps. The paths of both webs are for example clearly shown, as substantially parallel and identical except for the gluing step which exists only for one of them and not for the other.

The vat (7) is disposed upon the main frame of the machine and is permanently fed with glue through a tank/pump/tube system in a known way. The gluing is made by a number of transversal parallel rolls (8), one of which being dipping in the glue and transferring by contact the glue to the next one, which in turn is in contact with a third roll (11) having raised parts shown in FIG. 2. The paper travels continuously between said third roll and a fourth one, and is coated with glue spots corresponding to said regularly disposed raised parts of said third roll (11).

The next stage comprises two convergent transversal creasing devices. Each of said devices includes two metal sheets systems (9), made of a number of deeply transversely corrugated metal sheets, which also converge to shape the paper web. Such an action being carried out during the travelling of the web, wheels (10) are provided along said metal sheets, reducing the longitudinal friction forces and facilitating said travel, despite the antagonist forces especially caused by the increasing friction resulting from the convergence during such a shaping stage.

At the input of the principal station (D) containing the modules (M1) and (M2) is a third module (MA) which can also be dismantled. This latter comprises two successive couples of rolls (12, 13), each couple including a roll with radial grooves and a solid roll. The relative position of such two rolls is reversed from one couple to the other. The transversal creasing is therefore completed by such auxiliary module (MA).

The transversal creasing is in fact a first approach of the moulding step itself. Due to the depth of the cells to mould, if the paper web was fed between the rolls without any pre-treatment aiming to loosen the material, said web would tear in many places as a result of the stresses existing in the areas of the male and female respectively raised and hollowed parts of the moulding rolls.

Such a loosening should be especially prepared transversally, since the longitudinal efforts are controlled and regulated by the moulding rolls which are driving the web during its travel. This is the reason of the existence of the station (C), which is in addition of the substantial length, since the creasing must be made rather deep and since it is progressively achieved in order not to impede the travelling.

FIG. 3 shows in detail the configuration of a module (M2) with a roll (14) having male cell prints (15).The rotating system comprises therefore only the roll (14), including the main gear (16). The shaft (38, 39) upon which said system is mounted is therefore not rotatable, and this is the reason why the electrical wires (17) can be disposed therein as a canal to feed the heating electrical coil (not visible) disposed in the roll (14).

If three-phase current wiring harness (380 v) had to feed a rotating system, this might cause multiple problems, in connection with the safety conditions and also with the mechanical strength of a rotating system. Now the present coil is fixed so that there is not any problem left in connection with the twisting of wires, the installation of rotating contacts and so on. Such a configuration allows also to transmit an elevated power (10 kW).

The feeding wires, as well as the one connected to the temperature sensor (no shown) are located within the shaft which is therefore hollow.

The frame of each module comprises at least two lateral plates (18, 19) disposed at the ends of the fixed shaft. For rigidification reasons, said frame also includes axial tubular bracing, such as shown in (20, 21).

Each module (M1), (M2), (MA) is fastened to the main frame of the machine by classical mechanical means such as bolts and nuts. They are therefore extremely rapid and easy to assemble and to dismantle. When a module is removed, the replacement of the rolls is carried out as follows: the module is oriented vertically upon one of the lateral plates, then the second lateral plate, in upper position, is removed, which is easy since it is fastened only by two or three nuts. The mounting roll is then easily removed with the rotatable gear (16).

The mounting of another roll with mould prints of a different size is performed in the same way. At least one of the rolls (14, 34) is driven by motor means through the gears (16, 22), and if necessary through belts or chains, if the driving means is distant.

The output station (E) also comprises a number of rolls and/or shafts equipped with attachments such as shown in FIGS. 1 and/or 2. The most important equipments are those provided to transversally and longitudinally cut the web, to get products immediately usable in the bottom of boxes or crates.

The rotating shaft equipped with an unbalance or with an outlying piece (23), having a sharp edge engaging the cellular paper web is used in combination with a counter-blade (41) to carry out the cutting operation. It is located downstream of a couple of shafts connected by a belt made of flexible material, which guides the web at the output of the moulding rolls (14, 34), particularly between two lateral sheets (40) operating as rotating knives in cooperation with counter-blades (42). Said wheels have for function to cut the lateral parts of the web.

Another rotating shaft (24) includes a shoe (25), the outlying end thereof being provided for printing upon the final product some required information, such as the size or the number of cells. Such a shoe works in combination with rolls (43).

According to a preferred configuration, the shafts (23) and (24) are synchronised and driven by an unique driving means and a transmission system of a known type comprising chains/spools/gears. Such a system, as well as all systems connecting motors and transmission devices, is located along the sides of the main frame, and protected by lateral covers such as those shown in (26).

I claim:

1. Machine for continuously making cellular packaging from a paper-like web material wound around at least on roll (2, 3) freely rotatable located at the input of the machine, each web travelling thereafter through a station (C) creating a transversal crease, then between two rolls (14, 34), at least one of which being driven by a drive means, allowing on the one hand the continuous driving of the web and on the other hand the moulding of the cells, one of said rolls (14) having over its peripheral surface male prints (15) of the cells whereas the other roll (34) has over its peripheral surface female prints (35) of the cells, the engagement of both male and female prints providing the driving of the web, which travels finally through an output station (E) having a cutting system connected to a drive means, cutting at regular intervals the cellular packaging web obtained at the output, characterised in that both driving rolls (14, 34) including said male prints (15) and female prints (35) are each disposed in a module (M1, M2), which is easily accessible and can be dismantled from outside the machine, comprising two lateral end plates (18, 19) linked by a shaft (38, 39) supporting a heating means (36, 37) and said moulding roll (14, 34), said heating means and moulding rolls being mechanically independent and superposed, the first one being fitted into a central bore of the second, the latter remaining freely rotatable and being readily extractable once one of the end plates has been removed.

2. Machine for continuously making cellular packaging according to claim 1, characterised in that the heating means of the moulding rolls (14, 34) comprises a substantially cylindrically shaped electric coil (36, 37) comprising a plurality of heating resistors fastened to the shaft (38, 39) of said module (M1, M2) and covered by the rotating cylindrical coaxial moulding roll (14, 34).

3. Machine for continuously making cellular packaging according to claim 2, characterised in that said heating coil (36, 37) is servo-controlled by a temperature sensor disposed within the moulding roll (14, 34), said coil comprising hair-pin shaped resistors.

4. Machine for continuously making cellular packaging according to claim 3, characterised in that said heating coil (36, 37) and said sensor are connected to feeding wires (17) disposed within the shaft, which is hollow.

5. Machine for continuously making cellular packaging according to any of preceding claims, characterised in that each moulding roll (14, 34), remaining freely rotatable with respect to the frame of the module (M1, M2) and the heating means (36, 37) fastened to the shaft (38, 39), is driven by a drive means located outside of the module and driving said roll (14, 34) through at least one mechanical linking means fastened to the roll and connected to said drive means.

6. Machine for continuously making cellular packaging according to claim 5, characterised in that said mechanical linking means comprises at least one gear (16, 22) connected to the drive means via a transmission chain.

7. Machine for continuously making cellular packaging according to any of preceding claims, characterised in that the cutting system comprises an unbalance (23) or an outlying piece (23) having a cutting sharp edge extending transversely to the machine, whose width is at least equal to the width of the cellular web, the rotation shaft supporting the unbalance (23) or the outlying piece (23), which are also linked to a drive means which drives it continuously in rotation, in synchronism with the moulds (14, 34), the unbalance (23) or the outlying piece (23) operating in combination with a counter-blade (41).

8. Machine for continuously making cellular packaging according to any of preceding claims, characterised in that the packaging are made from two paper webs issued from two distinct rolls (2, 3) freely rotatable and placed at the input of the machine, said webs being glued together by a number or transversal rolls (8), one of these rolls being dipping in a glue vat while another, which is in contact with the latter, transfers the glue to a third roll (11) having regular raised portions getting coated with glue, said third roll (11) then forming continuously spots of glue upon one of the webs, two further rolls positioning the glued web at the input of station (C) which creates the transversal crease.

9. Machine for continuously making cellular packaging according to claim 8, characterised in that each web is thereafter travelling through a station (C) creating a transversal crease identical for each web, the lamination of both webs being carried out during the moulding stage by the two moulding rolls (14, 34).

10. Machine for continuously making cellular packaging according to any of preceding claims, characterised in that the transversal creasing is carried out by two metal sheet systems comprising a number of deeply corrugated metal sheets which are convergent one towards the other and which work at regular intervals with wheels (10) helping the travelling of the web.

* * * * *